US005111949A

United States Patent [19]

Ambrosi et al.

[11] Patent Number: 5,111,949

[45] Date of Patent: May 12, 1992

[54] STOPPERING DEVICE WITH ROTATING CAP

[75] Inventors: Jacques Ambrosi, Villefranche sur Saone; Philippe Odet, Chasselay, both of France

[73] Assignee: Astra Plastique, De Reneins, France

[21] Appl. No.: 671,971

[22] Filed: Mar. 19, 1991

[30] Foreign Application Priority Data

Apr. 13, 1990 [FR] France ..... 90 05157

[51] Int. Cl.[5] ..... B65D 51/16

[52] U.S. Cl. ..... 215/313; 215/311; 222/153; 222/521

[58] Field of Search ..... 215/218, 221, 330, 331, 215/311, 313; 222/153, 521

[56] References Cited

U.S. PATENT DOCUMENTS 3,910,463 10/1975 Reese ..... 222/153
3,941,268 3/1976 Owens et al. ..... 215/218
4,305,517 12/1981 Dennis .
4,779,764 10/1988 Debetencourt .

FOREIGN PATENT DOCUMENTS 2600978 5/1986 France .
2126201 3/1984 United Kingdom ..... 215/221

*Primary Examiner*—Stephen P. Garbe
*Assistant Examiner*—Paul A. Schwarz

[57] ABSTRACT

A cap comprising a cylindrical skirt extending from a frustoconical part, the connecting area between the cylindrical skirt and the frustoconical part being located essentially at the level of a shoulder provided in a body composed of a stopper body or in the container to be equipped itself. This connecting zone has at least one tongue delimited by two vertical slots and one horizontal slot, the horizontal edge of the tongue delimited by the slot being provided on the inside of the cap with an extension forming a first tooth which is located, when the cap is in the closed position, adjacent to a second tooth or projection associated with body when the cap is located in the unscrewing direction.

8 Claims, 2 Drawing Sheets

FIG. 3
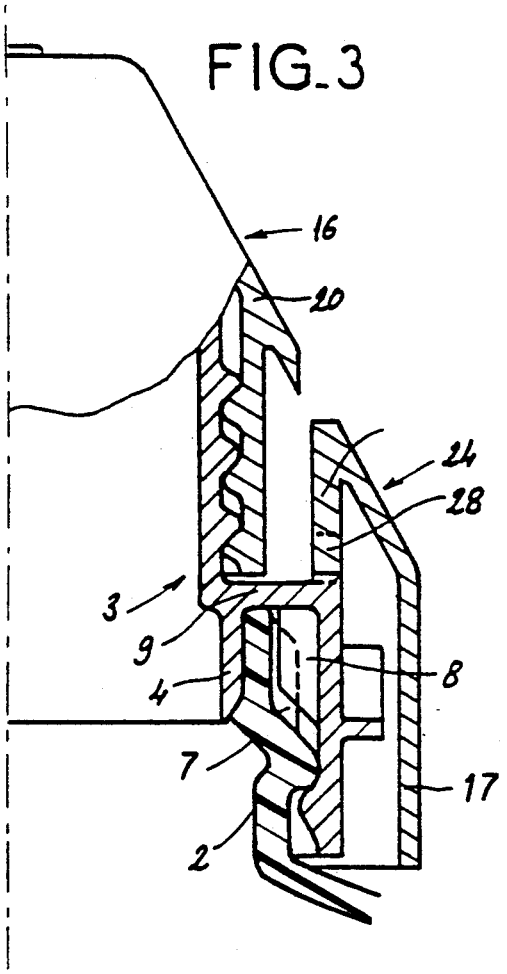
FIG. 4
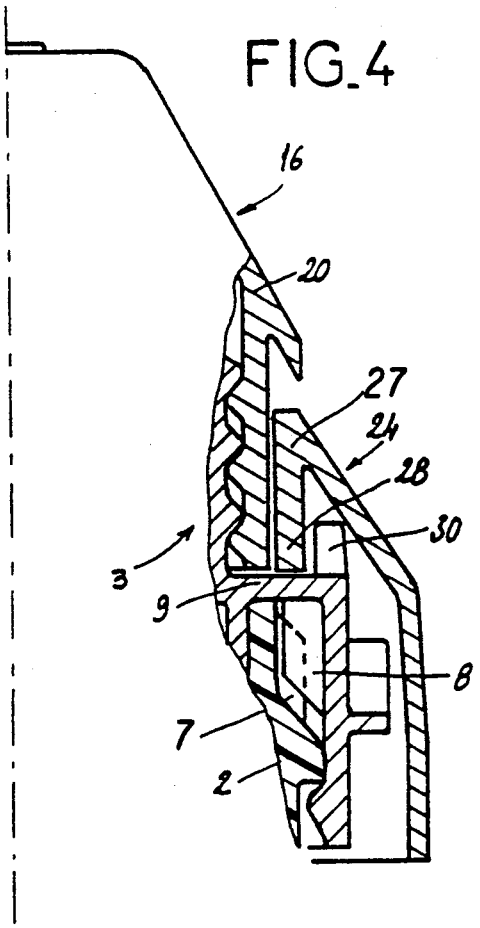
FIG. 5
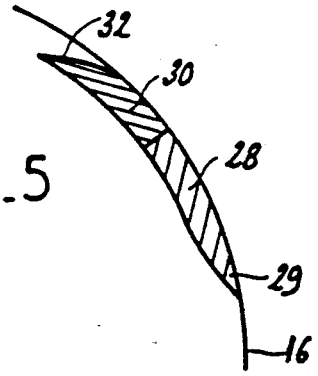
FIG. 6
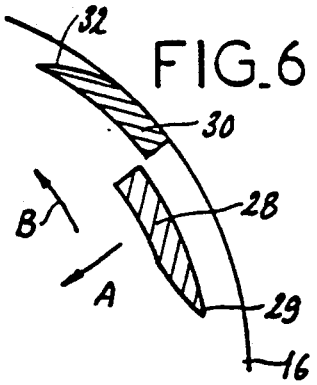
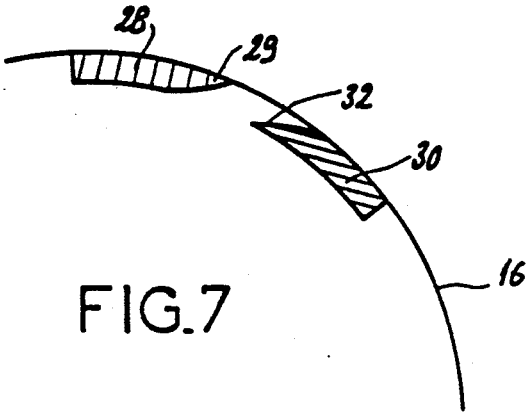
FIG. 7

STOPPERING DEVICE WITH ROTATING CAP

TECHNICAL FIELD

The present invention relates to a stoppering device with a rotating cap.

BACKGROUND

It is known that stoppering devices with rotating caps can be made such that the rotating cap can be associated directly with the neck of the container to be sealed or can be associated with a stoppering body itself which is permanently mounted on the container.

The latter type of stoppering device can be composed, for example, of a dispensing stopper comprising a stopper body permanently mounted on a container with elastically deformable walls, especially designed to contain semi-liquid or pasty products. The stopper body is mounted permanently on the neck of the container. The stopper body has a central boss which is capable of blocking, with a sealing action, a central opening provided in the cap when the neck of the container is in a specific orientation. The central boss is also capable of defining a passageway which regulates the flow of the container contents when the central opening is in an angular orientation.

A stoppering device of this type is described in particular in French Patent 8,606,958, in the name of the applicant.

The device described in French Patent 8,606,958 comprises a cap which, when pivoted relative to the body of the stopper, shifts axially relative thereto, and reveals a passageway for removal of the product.

While this device provides complete satisfaction as far as its structure and reliability are concerned, it suffers from the disadvantage of being able to be opened easily by simply rotating the cap relative to the body of the stopper.

In the case of hazardous products it is desirable to complicate the process of opening the device, firstly to prevent accidental opening of the container and secondly to prevent young children from managing to open it.

SUMMARY OF THE INVENTION

It is therefore an object of the present invention to provide a stoppering device with a rotating cap which requires the simultaneous performance of two completely distinct movements to open it.

To this end, the present invention is of the type in which the stopper cap comprises a cylindrical skirt, extending into a frustoconical part. The connecting zone between the cylindrical skirt and frustoconical part is located essentially at the level of a shoulder, located in a plane perpendicular to the axis of the stoppering device. The connecting zone may be defined by the body of the stopper or by the container itself. The connecting zone contains at least one tongue, preferably delimited by two vertical slots, and one horizontal slot. The horizontal edge of the tongue delimited by the horizontal slot is located on the inside of the cap, and has an extension forming a tooth located, when the cap is in the closed position, adjacent to a tooth belonging to the body, when the cap is located in the unscrewing direction.

When the stoppering device is in the closed position, the cap is prevented from rotating by the contact which each tooth has, by virtue of a tongue which it comprises, with a corresponding tooth provided in the body. Consequently, in order to open the device, it is necessary first, to exert a radial pressure on each tongue in order to release it from the corresponding tooth in the body, before finally performing a rotary unscrewing motion.

It is therefore necessary to perform a procedure which cannot be accomplished accidentally or by a young child because of the required coordination of different movements.

BRIEF DESCRIPTION OF THE DRAWINGS

The invention will be thoroughly understood from the following description and with reference to the attached schematic diagrams which show as a nonlimiting example one embodiment of this stoppering device.

FIG. 3 is a longitudinal section along line III—III in FIG. 1, with a cap in the closed position;

FIG. 4 is a view similar to the one in FIG. 3 during the opening procedure;

FIGS. 5 to 7 are three detailed views showing the respective positions, in a section along a horizontal plane, of one notch of one tongue and of the corresponding notch in the body of the stopper, in the closed position (FIG. 5) during opening (FIG. 6) and during the closure of the stoppering device (FIG. 7).

DETAILED DESCRIPTION OF PREFERRED EMBODIMENTS

According to one embodiment of this device, a tooth or projection is provided on a body and projects from the shoulder, perpendicular to the axis of the body, and upward and close to the outer edge of the shoulder.

Advantageously, the tooth attached to the extension of each tongue is shaped from front to back in the screwing direction, with its front end being tapered. In addition, each tooth or projection attached to the body is shaped in the reverse fashion from that of the corresponding tooth in the cap, with its tapered edge being displaced inward relative to its longitudinal midline.

The result of this toothed structure requires that before performing the rotary movement of the cap it is necessary to exert a pressure on each tongue in order for each tooth of the structure to escape from the corresponding tooth or projection on the body of the device by radial displacement. During rotational movement, the tooth of the tongue passes over the tooth of the body again. During the closing movement, it is sufficient for the user to exert a rotational movement on the cap, and the respective shapes of the notches in the cap and body will permit them to pass over one another, with the tooth in the cap passing outside the tooth in the body projection. The elasticity of the structure material causes the two teeth to be extensions of one another when the device is in the closed position.

According to one characteristic of the invention, each tongue is delimited by two vertical slots and one horizontal slot at its upper end, said upper edge being provided with an extension oriented parallel to the axis of the cap. Advantageously, the cap comprises two diametrally opposite tongues. This latter characteristic makes the opening movement even more complicated since it requires exerting pressure not only on one tongue but on two tongues simultaneously.

Figure 2:
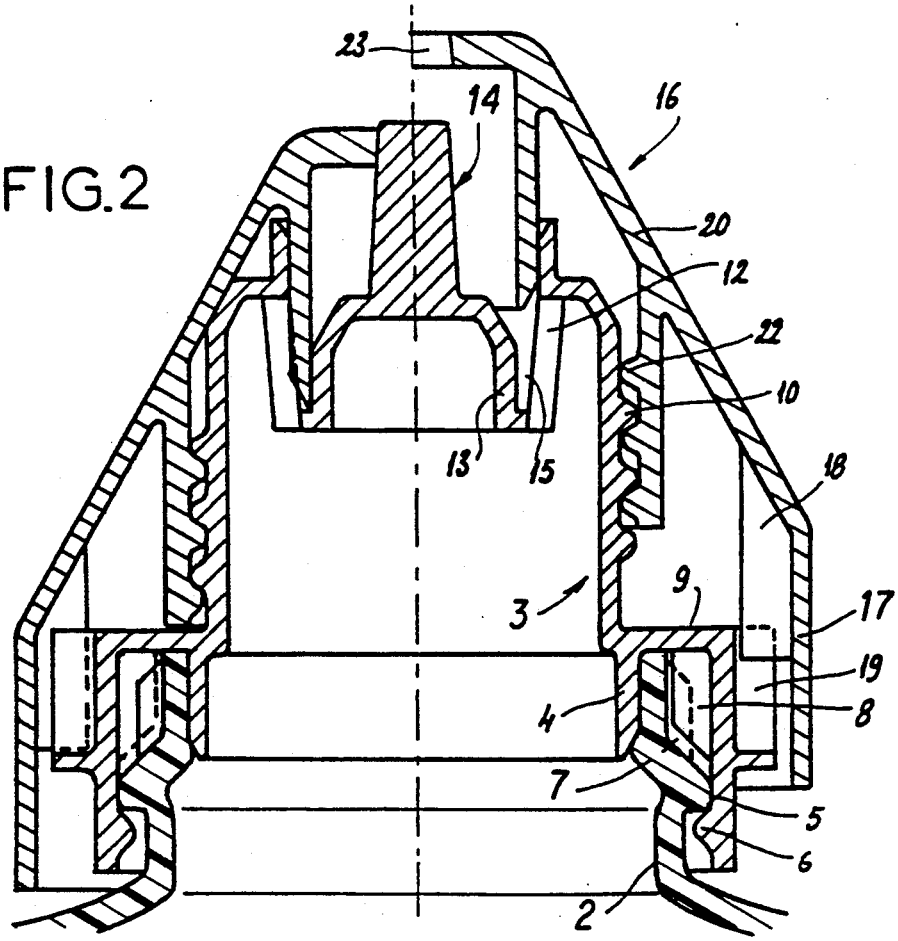
FIG. 2 is a longitudinal section along line II—II in FIG. 1.

The stoppering device shown in the Figures is intended, for example, to be mounted on a container whose neck 2 is shown in FIGS. 2 to 4, made of an elastically deformable synthetic material whose elastic deformation caused by pressure exerted by the user permits expulsion of the pasty or semi-liquid product which it contains.

Body 3 of the stopper is mounted in permanent fashion on neck 2, said body comprising a part 4 designed to fit tightly over neck 2 to seal it. Mounting is accomplished by means of complementary bosses 5 and 6 provided respectively on the neck and body of the stopper, with rotary locking being provided by teeth 7 and 8, respectively, provided in the neck and body of the stopper.

Body 3 of the stopper, because of its enclosing part, has a shoulder 9 with an axis perpendicular to the axis of the body. The body of the stopper is continued as a cylindrical part comprising beads 10 which act as threads. This cylindrical part is connected by feet 12 to a central nipple 13 from which a boss 14 emerges. Openings 15 are provided between feet 12 to allow the passage of the product.

A cap 16 is designed to be mounted on the body 3 of the stopper. This cap 16 comprises a cylindrical skirt 17 designed to cover the lower end of the stopper body an may be equipped with a tamper-proofing strip, not shown in the drawing. This cylindrical skirt 17 comprises prongs 18 which cooperate with ramps 19 which the body of the stopper has to permit axial displacement of the cap relative to the body when the cap is rotated in the unscrewing direction.

This cylindrical part 17 forming a skirt is extended upward by a frustoconical part 20. This frustoconical part 20, projecting inward, has a cylindrical part comprising beads 22 designed to cooperate with beads 10 of the stopper body in order to permit axial displacement of the cap relative to the body to move from the open position to the closed position. The end of the cap has an opening 23 designed to cooperate with central boss 14 to close the container when the opening fits over the central boss or to open the container when said opening 23 is released from the boss.

Figure 1:
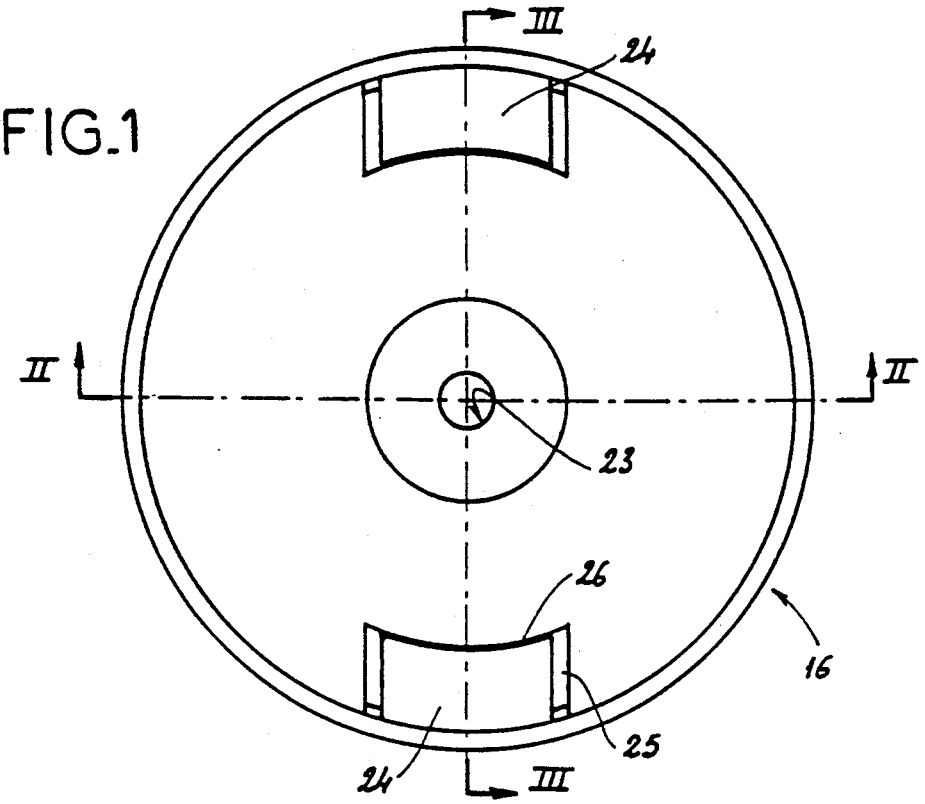
FIG. 1 is a top view.

As shown in FIG. 1, cap 16 comprises two tongues 24 located diametrally opposite one another, each tongue located essentially in the connecting zone between skirt 17 and frustoconical part 20, being delimited by two vertical slots 25 and by one upper horizontal slot 26. At the level of its upper edge delimited by slot 26, tongue 24 is provided with a vertical extension 27. This extension 27 is located essentially at the level of the outer edge of shoulder 9 of body 3. The lower end of extension 27 forms a first tooth 28 whose front end is tapered in the screwing direction, in other words it has a tapered edge 29. Each tongue 24 has associated with it a second tooth or projection 30 provided in the body of stopper 3, projecting upward from shoulder 9. Second tooth 30 is located in the extension of first tooth 28 of the tongue when the device is in the closed position. Unlike first tooth 28, second tooth 30 is shaped in the reverse fashion, with its end located opposite end 29, forming a tapered edge 32, and is turned inward.

From a practical standpoint, when the stoppering device is in the closed position, as shown in FIG. 3, second teeth 30 of body 3 block first teeth 28 of cap 16 when an attempt is made to unscrew the cap. Consequently, in order to be able to open the stoppering device, it is necessary, starting in the position shown in FIG. 5, to exert a radial pressure inward on the two tongues 24 so that the first teeth 28 thereof are displaced inward, as shown by arrow A in FIG. 6, so that the cap can pivot in the direction of arrow B, during which pivoting each first tooth 28 passes behind corresponding second tooth or projection 30 in the body of the stopper. It should be noted that in order to reclose the stopper it is sufficient to exert a rotational movement on the cap in a screwing direction, because the matching shapes 29, 32 of first tooth 28 and second tooth or projection 30, respectively, will allow first tooth 28 to pass second tooth or projection 30 on the outside. When teeth 28 and 30 are no longer in the overlapping position, first tooth 28 returns into the extension of second tooth or projection 30 because of the elasticity of the material.

As may be seen from the above, the invention ensures a considerable improvement in existing technology by furnishing a stoppering device of simple design whose opening requires coordination of a plurality of movements, which avoids any risk of accidental opening or of the container being opened by a young child.

Of course the invention is not limited to the single embodiment of this device described above as an example and on the contrary includes all variations thereon; thus, the stoppering device need not consist of a stopper body and a cap, but the cap could be mounted directly on the neck of the container which in turn would have locking teeth without thereby departing from the scope of the invention.

What is claimed is:

1. A stoppering device for selectively closing a container having a neck cooperating with a threaded body, the threaded body defining a shoulder having an axis perpendicular to the longitudinal axis of the body and a projection extending from the shoulder in a longitudinal direction of the body, the stoppering device comprising:

a cap having corresponding threads for rotational association with said body, said cap including a cylindrical skirt, a frustoconical portion extending from said skirt, and a connecting zone defined between the frustoconical portion and the cylindrical portion and located along the longitudinal axis at a level adjacent to the shoulder;

said connecting zone including at least one tongue elastically radially displaceable relative to the longitudinal axis of the body and having an extension projecting therefrom for selective engagement with the projection on the shoulder to prevent rotational disassociation of said cap and body, said tongue being elastically displaced radially inwardly to disengage the extension from the projection to permit rotational disassociation of said cap and body; wherein said tongue is defined by two vertical slots extending in a longitudinal direction relative to the body and a horizontal slot extending between the two vertical slots, and the extension projects from an edge of the tongue defined by the horizontal slot in a longitudinal direction relative to the body.

2. The stoppering device of claim 1, wherein the projection extends upwardly perpendicular to the axis of the shoulder and is located adjacent an outer edge of the shoulder.

3. The stoppering device of claim 1, wherein the cap is rotationally associated with the body by rotating the cap in a screwing direction, and rotationally disassociated from the body by rotating the cap in an opposite unscrewing direction; and wherein a front edge of the extension defined in the screwing direction is tapered.

4. A stoppering device of claim 3, wherein the projection of the body is tapered in an opposite sense relative to the tapered extension.

5. The stoppering device of claim 4, wherein the extension slides across the projection in the screwing direction for rotationally associating the cap with the body.

6. The stoppering device of claim 1, wherein the cap includes two diametrically opposed tongues.

7. The stoppering device of claim 1, wherein the threaded body is integral with the neck of the container.

8. The stoppering device of claim 1, wherein the extension includes a first tooth and the projection includes a second tooth, the first tooth selectively engaging the second tooth.

* * * * *